US012392091B2

(12) United States Patent
Ripoll García

(10) Patent No.: US 12,392,091 B2
(45) Date of Patent: Aug. 19, 2025

(54) MODULAR FASTENING FOR TRACK CROSSINGS

(71) Applicant: PANDROL IBERICA S.A.U., Barcelona (ES)

(72) Inventor: Rubén Ripoll García, Barcelona (ES)

(73) Assignee: PANDROL IBERICA S.A.U., Barcelona (ES)

( * ) Notice: Subject to any disclaimer, the term of this patent is extended or adjusted under 35 U.S.C. 154(b) by 839 days.

(21) Appl. No.: 17/614,330

(22) PCT Filed: May 24, 2019

(86) PCT No.: PCT/ES2019/070346
§ 371 (c)(1),
(2) Date: Nov. 24, 2021

(87) PCT Pub. No.: WO2020/240050
PCT Pub. Date: Dec. 3, 2020

(65) Prior Publication Data

US 2022/0220672 A1 Jul. 14, 2022

(51) Int. Cl.
*E01B 7/22* (2006.01)
*E01B 9/30* (2006.01)
*E01B 9/38* (2006.01)

(52) U.S. Cl.
CPC ..... *E01B 7/22* (2013.01); *E01B 9/303* (2013.01); *E01B 9/38* (2013.01)

(58) Field of Classification Search
CPC ... E01B 7/22; E01B 9/38; E01B 9/303; E01B 9/42; E01B 9/40; E01B 9/44
See application file for complete search history.

(56) References Cited

U.S. PATENT DOCUMENTS 837,706 A * 12/1906 Moss ..... E01B 9/42 55/459.3
1,405,607 A * 2/1922 Markovich ..... E01B 9/40 238/334

(Continued)

FOREIGN PATENT DOCUMENTS

CN 107217555 A * 9/2017
EP 2719827 A1 * 4/2014 ..... E01B 9/38

(Continued)

OTHER PUBLICATIONS

International Search Report and Written Opinion for PCT/ES2019/070346, mailed Jan. 30, 2020.

*Primary Examiner* — S. Joseph Morano
*Assistant Examiner* — Cheng Lin
(74) *Attorney, Agent, or Firm* — MARSHALL, GERSTEIN & BORUN LLP

(57) ABSTRACT

A modular fastening for track crossings includes a lower plate and a shoulder bonded by means of adhesive to each end The lower plate includes a central segment running between the shoulders on a face above the face for anchoring to the support surface. The fastening includes two plate assemblies, which can be mounted on the lower plate by means of two rail spikes going through the plate assembly and allowing the fixing of a rail. Each plate assembly includes an intermediate plate, the lower face containing a recess for the fitting thereof on the central segment of the lower plate, and the upper face containing a circular projection configured for fitting in a circular recess located on a lower face of an upper plate on which a rail can be supported, such that said upper plate can be oriented with respect to said intermediate plate.

7 Claims, 11 Drawing Sheets

(56) References Cited

U.S. PATENT DOCUMENTS

| | | | | |
|---|---|---|---|---|
| 2,235,776 | A | 3/1941 | Herschel | |
| 2019/0211512 | A1* | 7/2019 | Mattson | E01B 9/38 |
| 2021/0040697 | A1* | 2/2021 | Garcia | E01B 7/28 |

FOREIGN PATENT DOCUMENTS

| | | | |
|---|---|---|---|
| EP | 3 290 583 | A1 | 3/2018 |
| FR | 2 719 827 | A1 | 11/1995 |
| KR | 200473880 | Y1 * | 8/2014 |

* cited by examiner

MODULAR FASTENING FOR TRACK CROSSINGS

TECHNICAL FIELD OF THE INVENTION

The present invention relates to a modular fastening for track crossings, having an application in the railway industry, and more specifically in the field of fastenings for turnouts on the outside of the switch diamond of the track, i.e., at an intersecting point of the two rails where two independent rails are required to be borne on a plate, the separation and orientation of which rails varies depending on the different support points of the rails along the track.

The invention allows fixing the rails in a quick and simple manner by means of a highly versatile fastening which, by means of a set number of identical elements in all the fastenings, allows the adaptation thereof to the different orientations and separations existing between rails along different points of the line layout, with the subsequent reduction in the costs of manufacturing and storing the fastenings needed to cover an entire segment of the intersection.

BACKGROUND OF THE INVENTION

The track frog is a critical region of railway track crossing areas that is of great importance in turnout safety. The track frog corresponds with the central part of the crossing in which the rails come together to form a single rail, and it has the function of correctly guiding the wheels of the railway vehicle in the rail intersection or crossing.

Therefore, said area may have different rail profiles, gradients, clips and securing plate sizes, resulting in major problems occurring during switching operations.

Plates, referred to as frog plates, comprising two inner shoulders that serve to fasten elastic rail securing clips are used today for securing or fastening rails in the track frog. The position of said inner shoulders in said plates is established in a predetermined manner according to the width of the rail. Therefore, the distance between the inner shoulders of a frog plate and the distance between consecutive or adjacent plates in the mentioned segment are different, which requires providing and using a wide range of plates with different distances between inner shoulders according to the distance required in each frog plate.

Frog plates usually comprise a metal bearing or lower plate, an upper plate, also of metal, and two anchoring end side shoulders. In the metal upper plate, there is a need to machine the edges, define the positioning of second shoulders, in this case inner shoulders, the position of which is determined according to the width and number of rails, make the corresponding boreholes, weld said second shoulders to the upper plate and finally subject the assembly formed by the upper plate, lower plate and end shoulders to a vulcanization or adhesive bonding phase, forming a fastening that is made as a single compact block on which fastening elements such as screws, nuts and clips are then arranged for fastening the rail.

In practice, three types of frog plates are commonly used according to their size, i.e., long, medium and short length type, which plates are obtained by casting and are subsequently vulcanized. In turn, each type of plate has a specific, predefined distance between the inner shoulders according to the position thereof in the track frog, with the drawbacks this entails in terms of production cost, storage cost and assembly complication.

On the other hand, there are situations in which a track requires the use of a reinforcement referred to as rolled iron or steel plate, consisting of a stiffening rod arranged between two tracks to provide greater stability, the positioning of which must also be defined, the corresponding holes made, welding carried out and the adhesive bonding with the aforementioned assembly performed.

The drawbacks of the frog plates described above include, among others, the fact that the processes for obtaining them are expensive and complex in terms of manufacturing operations. Additionally, they are subject to a plurality of variations in the positioning and the boreholes required for the elements involved, resulting in the need for multiple plate references according to the width and/or number of rails in this track frog segment.

Finally, they have the limitation that they only serve for being used in the track frog, i.e., they are configured for receiving a single support, therefore their external adaptation to the frog, i.e., when there are two independent rail supports, is extremely complicated and expensive.

DESCRIPTION OF THE INVENTION

The present invention relates to a modular fastening for track crossings, which allows the independent orientation of two plate assemblies, mounted on one and the same lower plate, such that it allows the adaptation thereof to a variable orientation of the two rails supported on the same plate along different points of the layout.

The modular fastening for track crossings proposed by the invention comprises a lower plate and a shoulder attached by means of adhesive bonding to each end of the lower plate, forming a single-block assembly. In turn, each shoulder comprises means for anchoring the fastening on a support surface. The lower plate comprises a central segment running between the shoulders on a face above the face for anchoring to the support surface.

Now according to the invention, the fastening comprises two plate assemblies. Each plate assembly can be mounted on the lower plate by means of two rail spikes going through the plate assembly and allows the fixing of a rail.

In turn, each plate assembly comprises an intermediate plate the lower face of which comprises a recess for the fitting thereof on the central segment of the lower plate, and the upper face of which comprises a circular projection configured for fitting in a circular recess located on a lower face of an upper plate on which a rail can be supported, such that said upper plate can be oriented with respect to said intermediate plate.

It is contemplated that the upper plate comprises at least two curved elongated holes, preferably one on each side of the rail and diametrically opposed to one another, allowing play of the rail spikes mounting the plate assembly on the lower plate.

In the intermediate plate, the area of the circular projection allows the positioning of the homologous area arranged on the lower face of the upper plate, whereas the recess of the lower face of the intermediate plate allows the fitting thereof in the lower plate on the central segment and the areas demarcating the guides defined below. Preferably, the intermediate plate is a metal plate.

In turn, the upper plate can be made of metal or plastic and comprises the curved elongated holes curving towards the inner portion of the plate itself, which allows adapting the orientation thereof.

The circular fitting and coupling segments between the upper and intermediate plates allow the latter to rotate one above the other in different positions, such that the curved elongated holes enable the adjustment by different degrees in both fastening assemblies for adapting them in an independent manner to rail orientation changes at a turnout. The degrees are determined depending on the curvature of the elongated holes, comprised between 0° and 15°, usually about 10°.

Likewise, the lower plate may comprise two parallel guides located in the central segment, running from one of the shoulders to the opposite shoulder, each guide comprising at least one enlargement which allows the insertion of a head of a rail spike for mounting each plate assembly, which allows regulation for adaptation thereof to the different separations between rails at different points of the line layout.

Therefore, the proposed fastening comprises two parallel longitudinal guides separated by a central segment, such that the guides allow the insertion of the head of respective rail spikes for fastening the plate assemblies to one another, and they also serve for cooperating with the elongated holes for regulating orientation.

For the insertion or removal of said heads of the rail spikes, each guide preferably comprises at least one enlargement or notch, such that once the heads are inserted and by means of the rotation thereof of 90°, they are coupled in said guides with the possibility of being moved longitudinally along the guides.

Preferably, two coach screws located in different guides go through each plate assembly.

It is contemplated that the recesses comprise grooved areas collaborating with corresponding grooved areas comprised in the central segment of the lower plate. The grooved parts are for cooperating with the recessed area of the intermediate plate, for acting during longitudinal movements of each plate (intermediate and upper) assembly with respect to the lower plate.

Likewise, the circular recesses of each upper plate may comprise a toothing collaborating with a corresponding grooving comprised in the annular projection of each intermediate plate.

In turn, a smooth segment on the upper face of the upper plate is suitable for placing in the upper portion a protective base plate.

The possibility that the upper plate comprises two slots, each for housing an elastic clip is contemplated, where each slot comprises a hole into which a screw can be inserted for mounting said elastic clip.

DESCRIPTION OF THE DRAWINGS

To complement the description that is being made and for the purpose of aiding to better understand the features of the invention according to a preferred practical embodiment thereof, a set of drawings is attached as an integral part of said description in which the following has been depicted with an illustrative and non-limiting manner.

PREFERRED EMBODIMENT OF THE INVENTION

Figure 1:
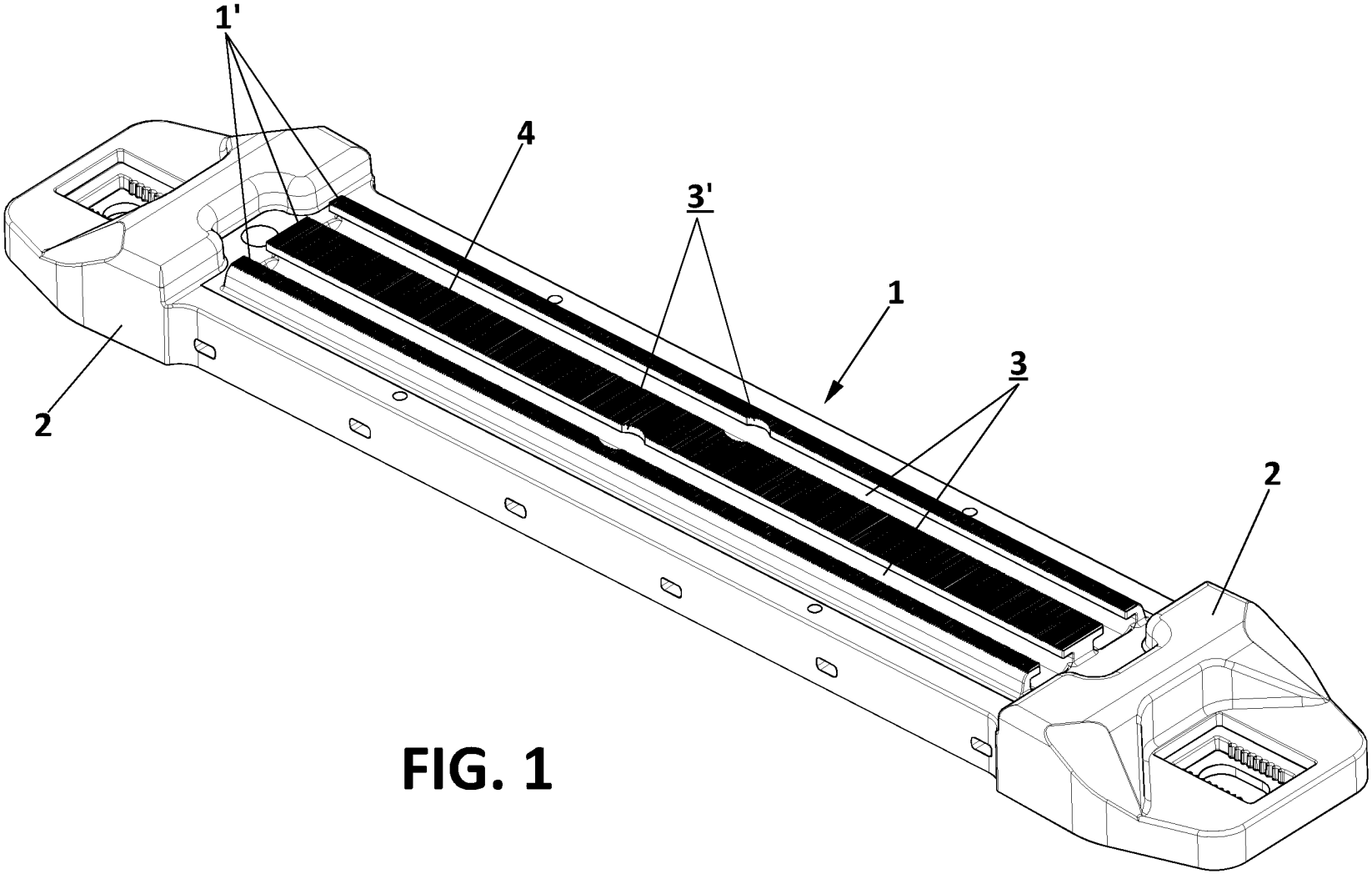
FIG. 1 shows a schematic perspective view of an embodiment of the lower plate comprised in the modular fastening of the invention.
Figure 2:
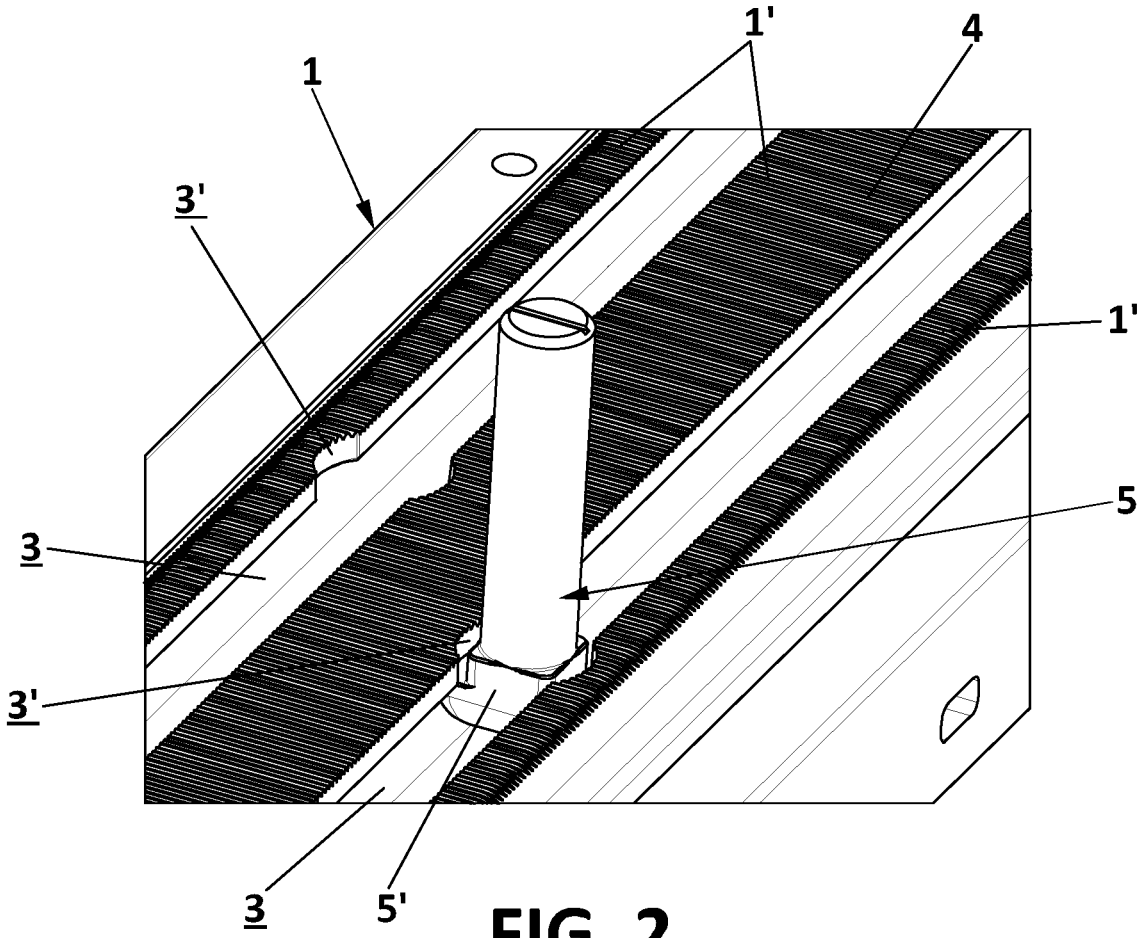
FIG. 2 shows a perspective view of a detail of the lower plate, where the insertion of the head of a rail spike in the enlargement of one of the guides comprised in the central segment of the upper face of the lower plate can be seen, and the grooved areas in said central segment can also be seen.
Figure 3:
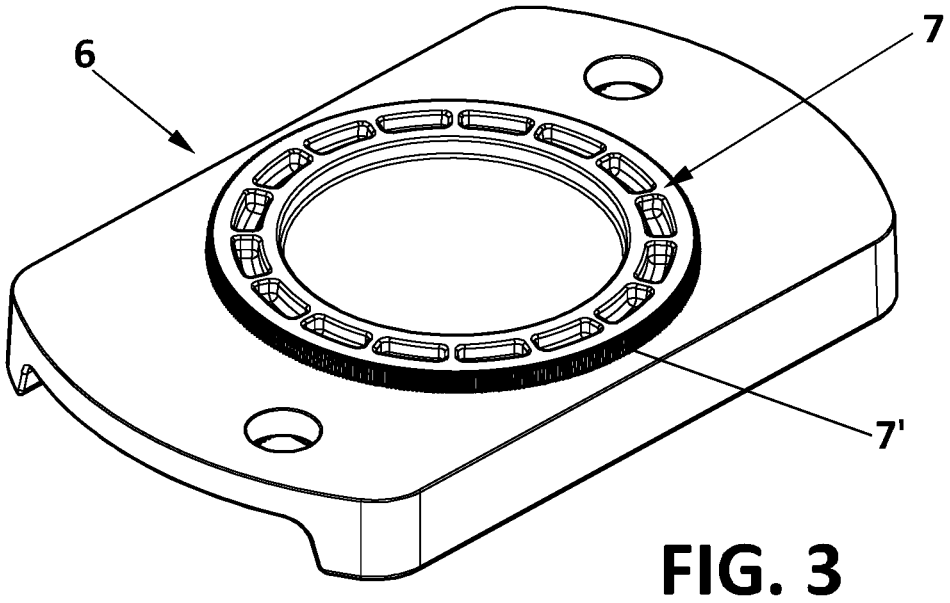
FIG. 3 shows a schematic perspective view of the upper face of one of the intermediate plates.
Figure 4:
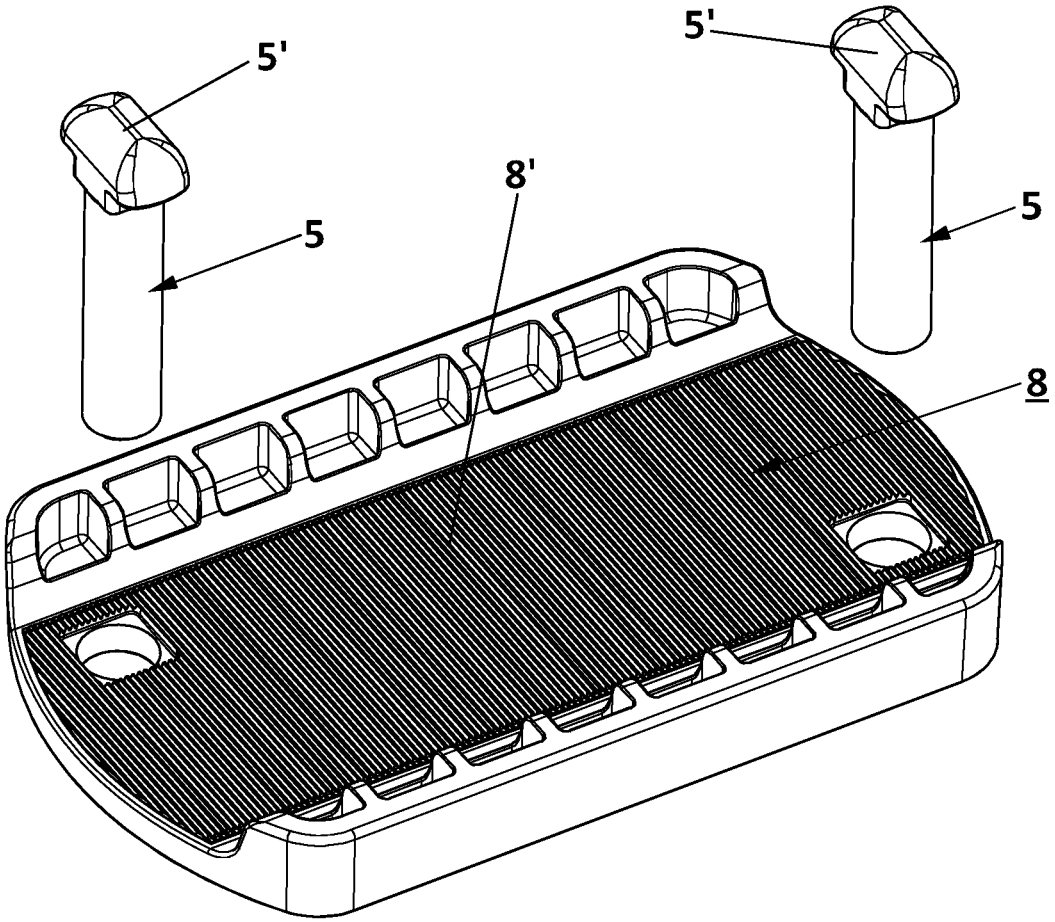
FIG. 4 shows a schematic perspective view of the lower face of one of the intermediate plates.
Figure 5:
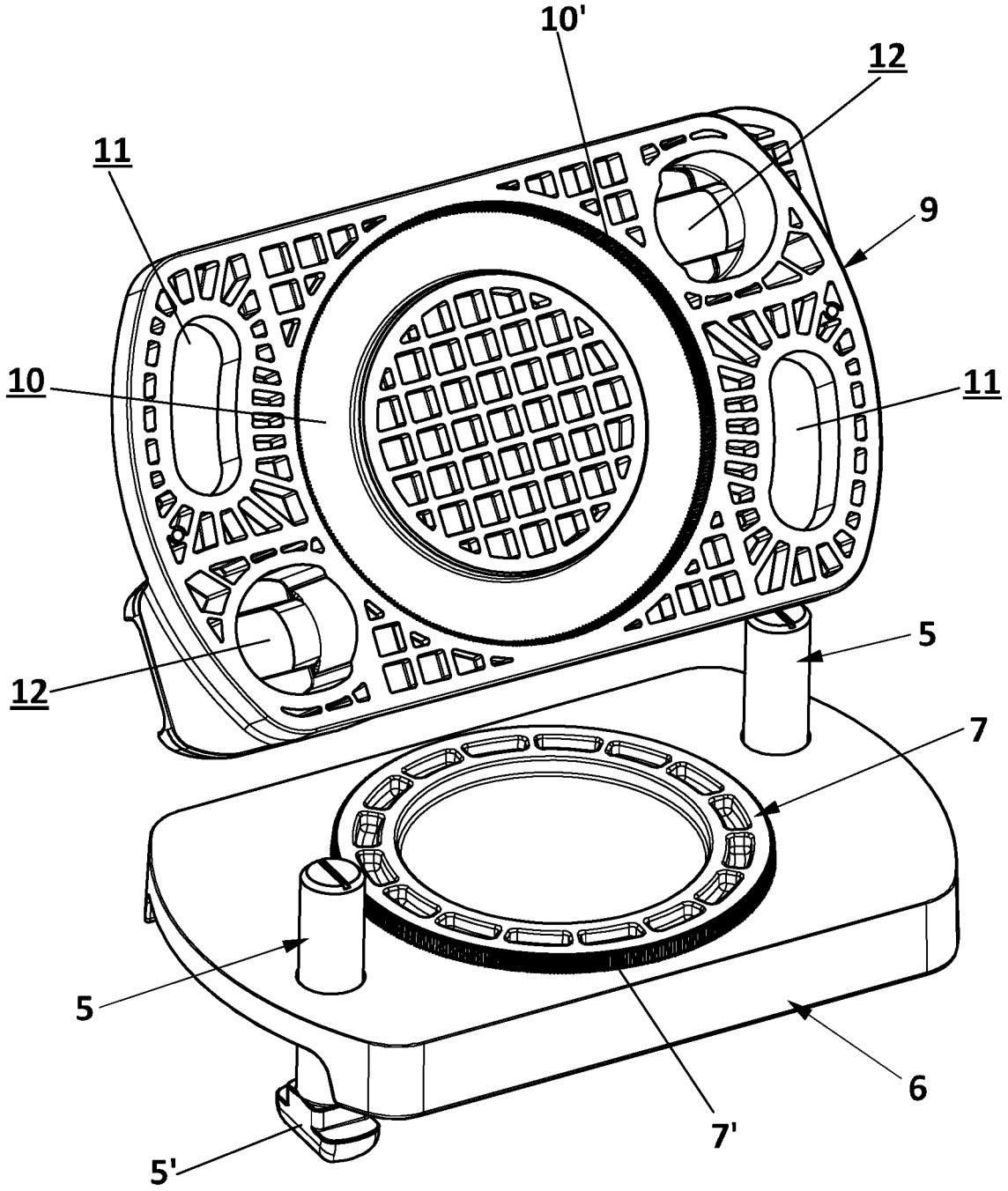
FIG. 5 shows a schematic perspective view of the coupling between an intermediate and an upper plate assembly.
Figure 6:
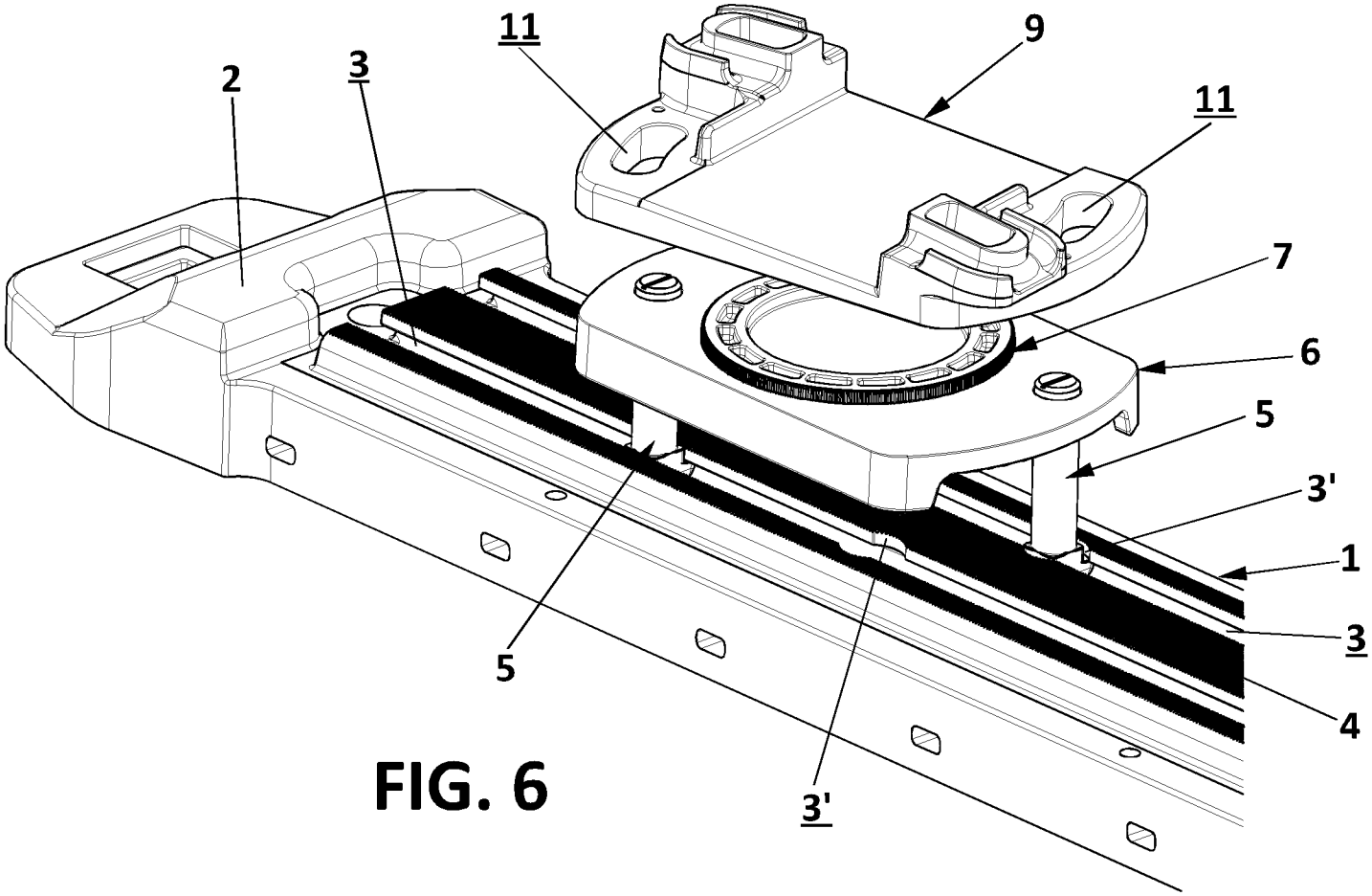
FIG. 6 shows a schematic perspective view of a plate assembly and its mounting on a lower plate.
Figure 7:
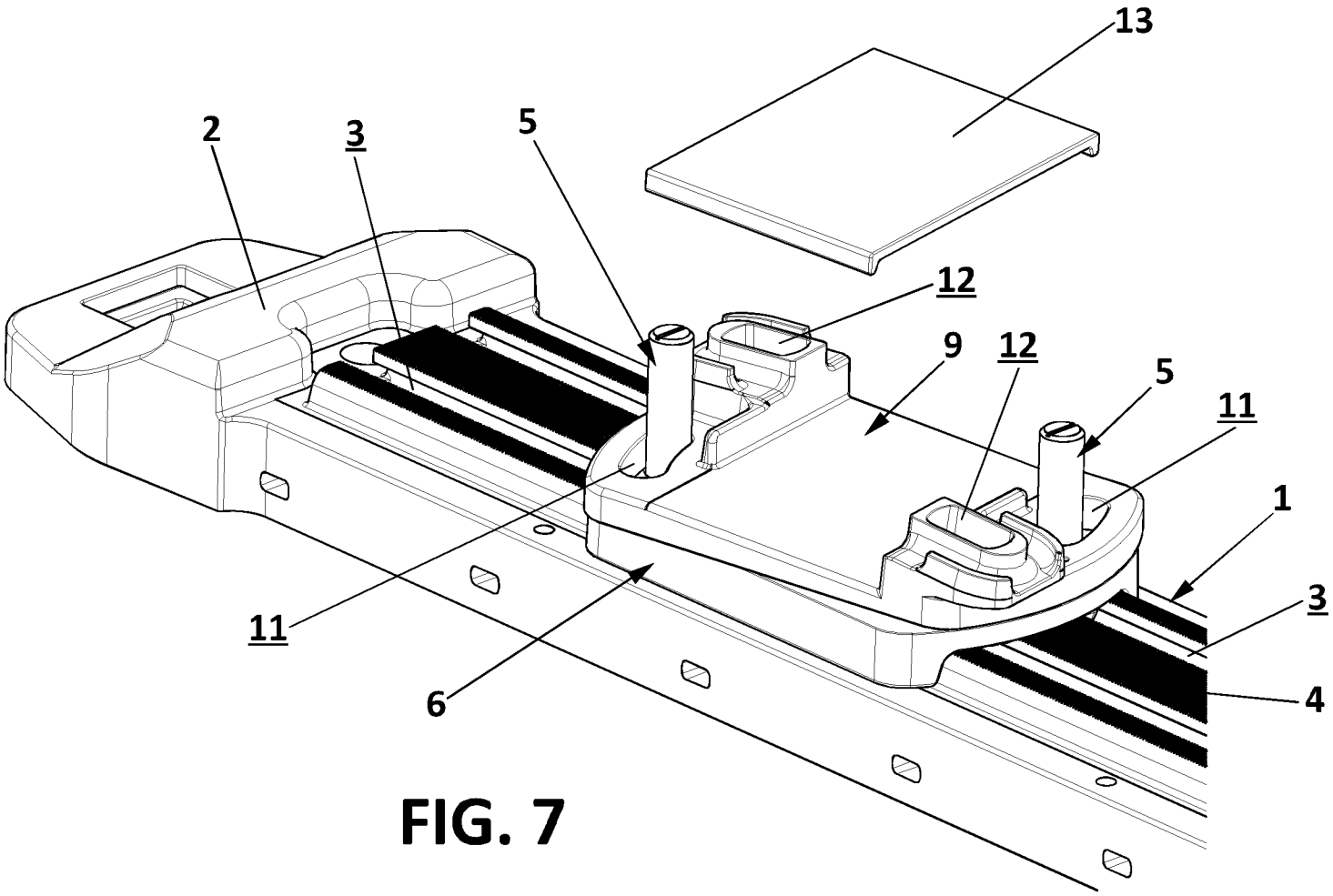
FIG. 7 shows a view like the preceding one in which a base plate for a rail can additionally be seen.
Figure 8:
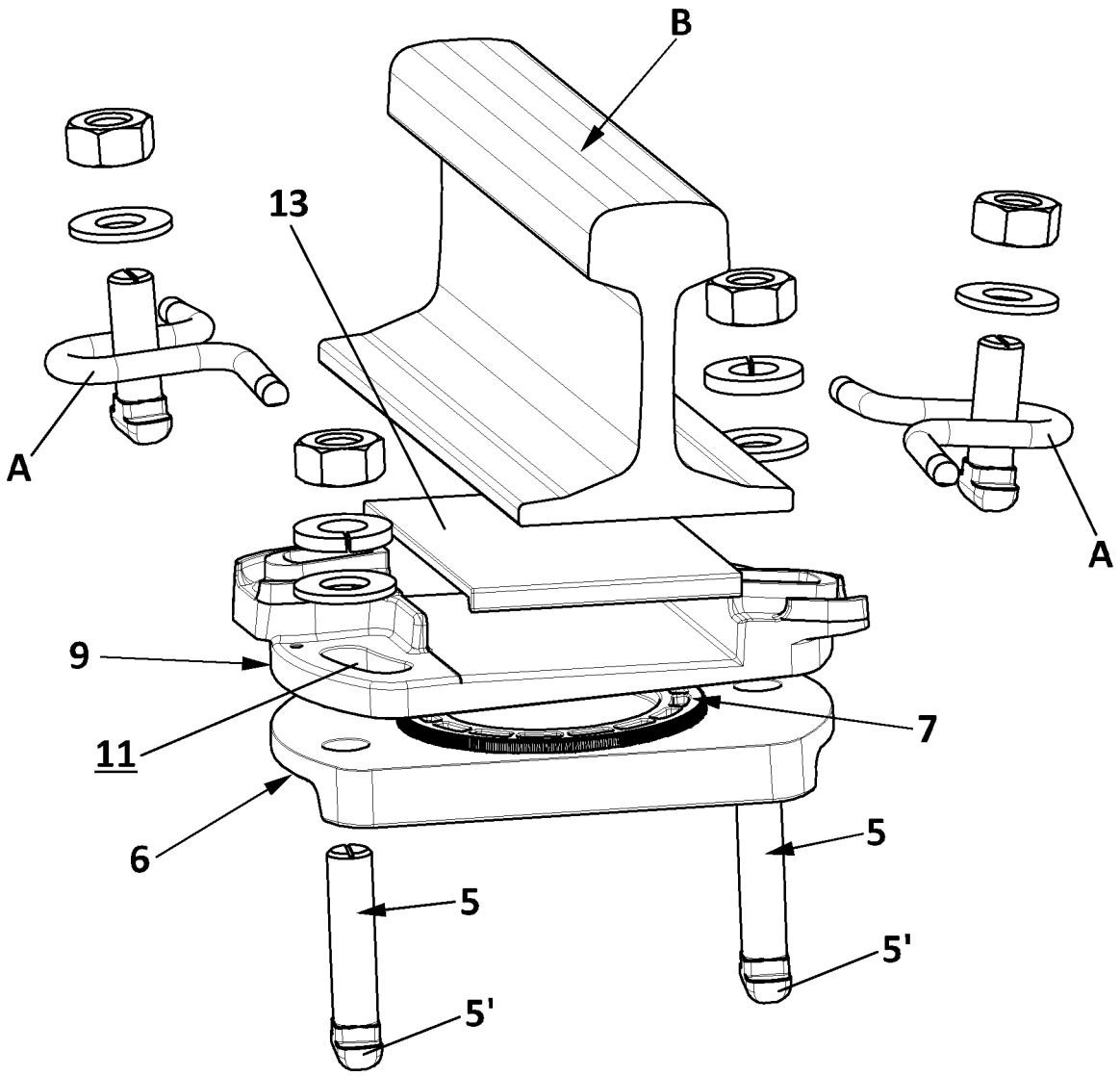
FIGS. 8 and 9 show two exploded views from a top and bottom perspective, respectively, of all the elements of the modular fastening of the invention, in addition to the rail.
Figure 9:
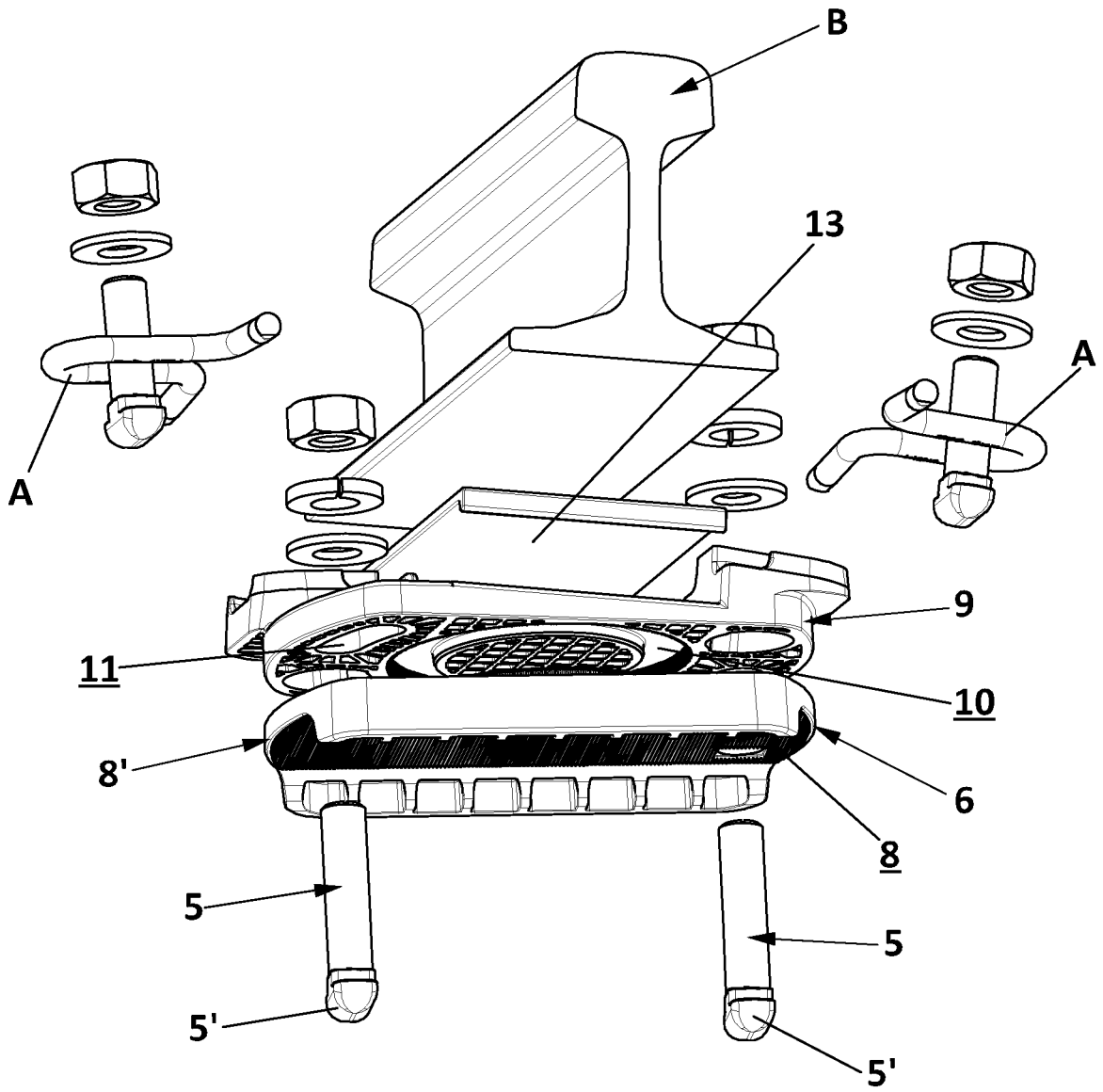
Figure 10:
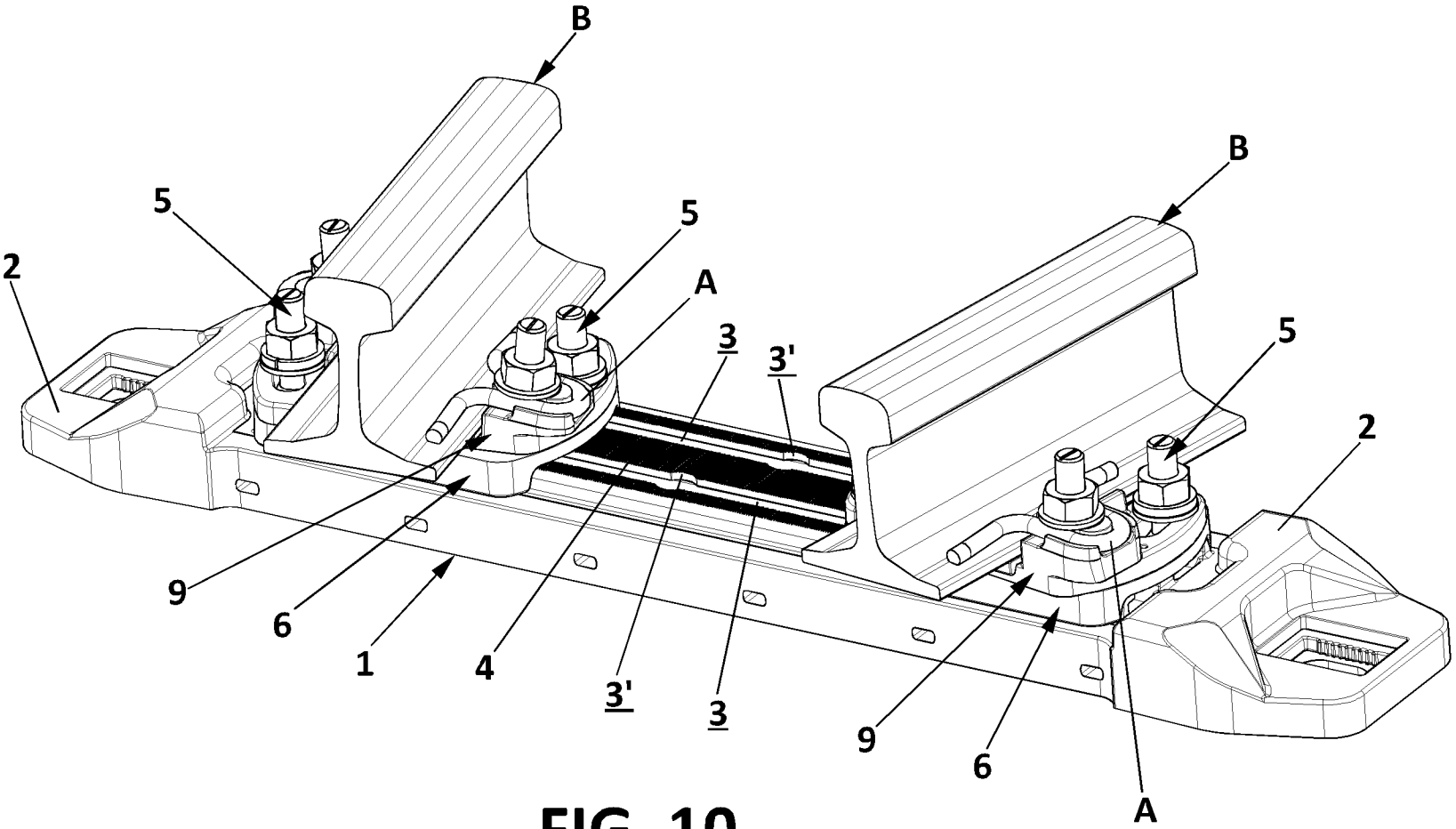
FIG. 10 shows a perspective view of an example of fastening two railway rails with different orientations and with a maximum separation by means of the modular fastening of the invention.
Figure 11:
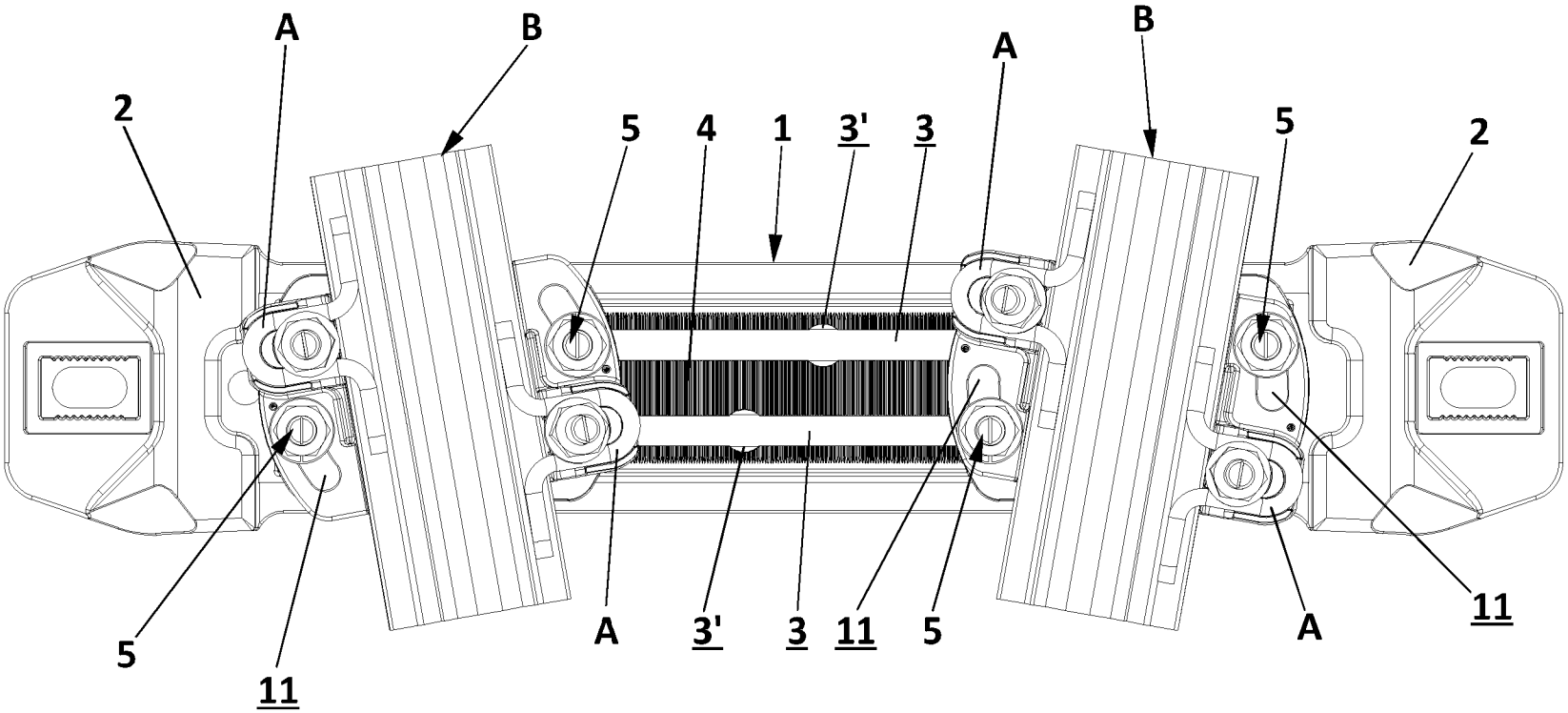
FIG. 11 shows a plan view of the example depicted in FIG. 10.
Figure 12:
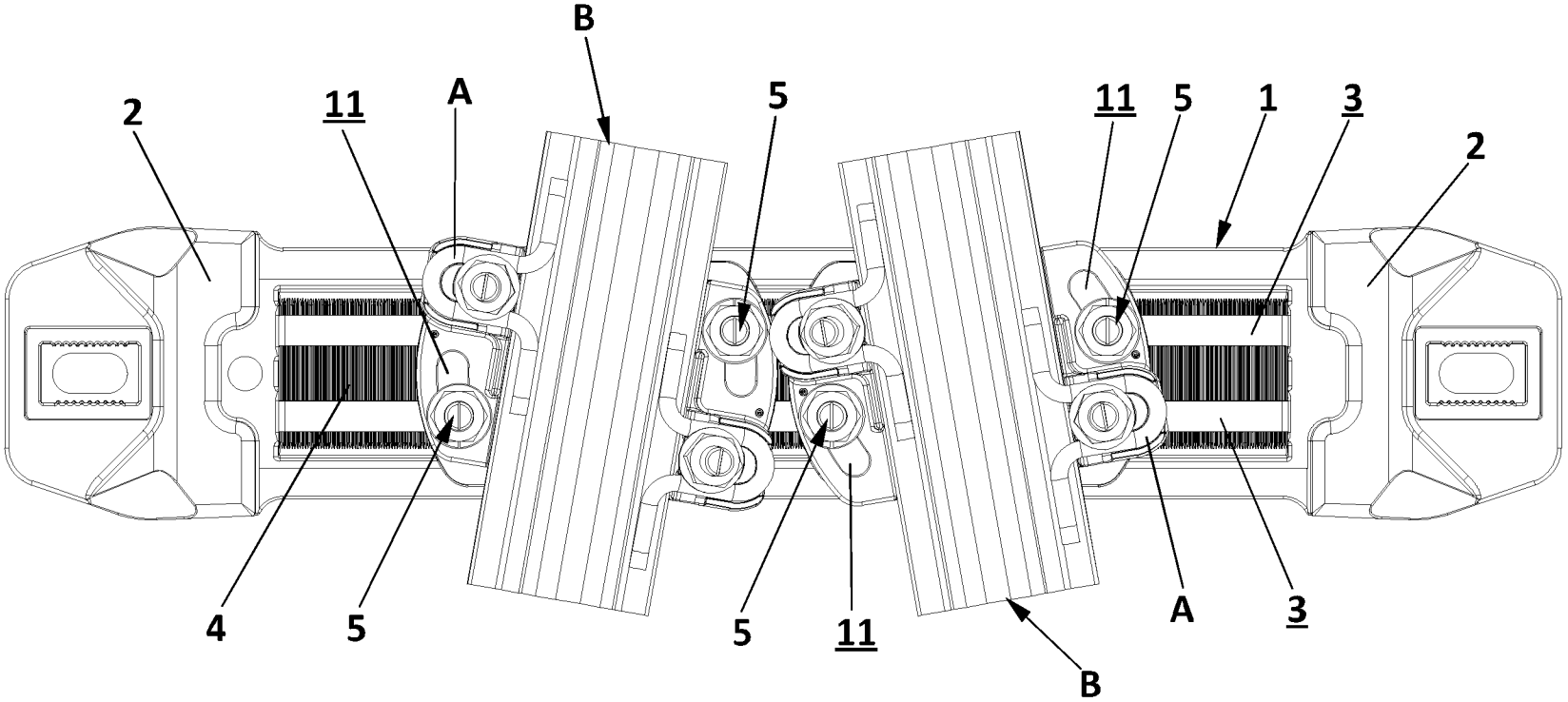
FIG. 12 shows a plan view like that of FIG. 11 of another example of orientation and minimum separation between rails.

In view of the described drawings, it can be observed how in one of the possible embodiments of the invention the modular fastening for track crossings proposed by the invention comprises a lower plate (1) and a shoulder (2) attached by means of adhesive bonding to each end of the lower plate (1), forming a single-block assembly, where each shoulder (2) comprises means for anchoring the fastening on a support surface, the lower plate (1) comprising a central segment (4) running between the shoulders (2) on a face above the face for anchoring to the support surface.

The fastening comprises two plate assemblies (6, 9), where each plate assembly (6, 9) can be mounted on the lower plate (1) by means of two rail spikes (5) going through the plate assembly (6, 9) and allows the fixing to a rail (B), each plate assembly (6, 9) comprising an intermediate plate (6) the lower face of which comprises a recess (8) for the fitting thereof on the central segment (4) of the lower plate (1), and the upper face of which comprises a circular projection (7) configured for fitting in a circular recess (10) located on a lower face of an upper plate (9) on which a rail (B) can be supported, such that said upper plate (9) can be oriented with respect to said intermediate plate (6).

Each upper plate (9) comprises two curved elongated holes (11) allowing play of the rail spikes (5) mounting the plate assembly (6, 9) on the lower plate (1).

The lower plate (1) comprises two parallel guides (3) located in the central segment (4), running from one of the shoulders (2) to the opposite shoulder (2), each guide (3) comprising at least one enlargement (3') which allows the insertion of a head (5') of a rail spike (5) for mounting each plate assembly (6, 9).

Two rail spikes (5) located in different guides (3) go through each plate assembly (6, 9).

In turn, the recesses (8) comprise grooved areas (8') collaborating with corresponding grooved areas (1') comprised in the central segment (4) of the lower plate (1).

The circular recesses (10) of each upper plate (9) comprise a toothing (10') collaborating with a corresponding grooving (7') comprised in the annular projection (7) of each intermediate plate (6). The toothing (10') and grooving (7') are made such that they cover the walls defining the perimeter of the respective circular recesses (10) and annular projections (7).

In turn, the upper face of the upper plate (9) comprises a smooth segment suitable for placing in the upper portion a protective base plate (13).

Finally, the upper plate (9) comprises two slots, each for housing an elastic clip (A), where each slot comprises a hole (12) into which a screw can be inserted for mounting said elastic clip (A).

The invention claimed is:

1. A modular fastening for track crossings, comprising: a lower plate and a shoulder attached by adhesive bonding to each end of the lower plate thereby forming a single-block assembly, where each shoulder comprises means for anchoring the modular fastening on a support surface, the lower plate comprising a central segment running between the shoulders on a face above a face for anchoring to the support surface, comprising:

two plate assemblies, where each plate assembly can be mounted on the lower plate by means of two rail spikes going through the plate assembly and allows the fixing of a rail, each plate assembly comprising an intermediate plate and an upper plate, wherein;

the lower face of the intermediate plate comprises a recess for the fitting thereof on the central segment of the lower plate, and the upper face of the intermediate plate comprises a circular projection configured for fitting in a circular recess located on a lower face of the upper plate on which a rail can be supported, such that:

the circular projection and circular recess between the upper plate and the intermediate plate allows the upper plate to rotate with respect to the intermediate plate in different positions; and wherein each two plate assemblies can be oriented independently so as to allow the adaptation thereof to a variable orientation of two rails supported along different points of a layout, and further wherein the upper plate comprises at least two curved elongated holes allowing play of the rail spikes mounting the plate assembly on the lower plate and the adjustment by different degrees in both plate assemblies for adapting them in an independent manner to rail orientation changes.

2. The modular fastening according to claim 1, wherein the at least two curved elongated holes of one and the same upper plate (9) are arranged diametrically opposed to one another.

3. The modular fastening according to claim 1, wherein the lower plate comprises two parallel guides located in the central segment, running from one of the shoulders to the opposite shoulder, each guide comprising at least one enlargement which allows the insertion of a head of a rail spike for mounting each plate assembly.

4. The modular fastening according to claim 3, wherein two rail spikes located in different guides go through each plate assembly.

5. The modular fastening according to claim 1, wherein the recesses of the intermediate plate comprise grooved areas collaborating with corresponding grooved areas comprised in the central segment of the lower plate.

6. The modular fastening according to claim 1, wherein the circular recesses of each upper plate comprise a toothing collaborating with a corresponding grooving comprised in the annular projection of each intermediate plate.

7. The modular fastening according to claim 1, wherein the upper plate comprises two slots, each for housing an elastic clip, where each slot comprises a hole into which a screw can be inserted for mounting said elastic clip.

* * * * *